US006557363B1

(12) United States Patent
Haasis et al.

(10) Patent No.: US 6,557,363 B1
(45) Date of Patent: May 6, 2003

(54) COOL WRAP FOOD SERVICE REFRIGERATION SYSTEM

(75) Inventors: Hans Haasis, Downey, CA (US); Don Hyatt, Downey, CA (US)

(73) Assignee: Omniteam, Inc., Downey, CA (US)

( * ) Notice: Subject to any disclaimer, the term of this patent is extended or adjusted under 35 U.S.C. 154(b) by 0 days.

(21) Appl. No.: 10/121,640

(22) Filed: Apr. 12, 2002

Related U.S. Application Data

(63) Continuation-in-part of application No. 10/033,600, filed on Dec. 27, 2001.

(51) Int. Cl.[7] ..... F25D 23/12; A47F 3/04
(52) U.S. Cl. ..... 62/258; 62/261; 165/918
(58) Field of Search ..... 62/258, 259.1, 62/261, 298; 165/169, 918, 919

(56) References Cited

U.S. PATENT DOCUMENTS 4,685,311 A 8/1987 Rastelli
5,168,719 A 12/1992 Branz et al.
5,355,687 A * 10/1994 Carpenter et al. ..... 62/258
5,363,672 A * 11/1994 Moore et al. ..... 62/258
5,381,672 A 1/1995 Haasis
5,927,092 A 7/1999 Kushen et al.
6,000,236 A 12/1999 Haasis
6,085,535 A * 7/2000 Richmond et al. ..... 62/258
6,089,036 A 7/2000 Carlson et al.
6,109,051 A * 8/2000 Majordy ..... 62/258

* cited by examiner

*Primary Examiner*—William E. Tapolcai
(74) *Attorney, Agent, or Firm*—Oppenheimer Wolff & Donnelly LLP

(57) ABSTRACT

A collar assembly including cooling coils is provided to increase the top surface cooling of food being served from food pans which are mounted to extend down into a food service cabinet or counter. The collar is preferably lower in the front toward the server or may be omitted for easy access, and is preferably higher at the back away from the server and on the sides for increased cooling. A principal cooling unit may be mounted in the cabinet to direct cold air onto the food pans; and the collar cooling coils and the principal cooling unit may be coupled to a single compressor and heat exchanger.

21 Claims, 4 Drawing Sheets

66
64

18
52
46
26
22
44
46
26
42
48
46
26
44
46
26
56
60
16
58

COOL WRAP FOOD SERVICE REFRIGERATION SYSTEM

RELATED PATENT APPLICATIONS

This application is a continuation-in-part of U.S. patent application Ser. No. 10/033,600, filed, Dec. 27, 2001 entitled "Cool Wrap Food Service Refrigeration System".

BACKGROUND OF THE INVENTION

This invention relates to refrigeration arrangements for increasing the cooling at the upper surface of food which is being served from food pans on a counter or cabinet.

FIELD OF THE INVENTION

It has previously been proposed to provide arrangements for increasing the upper surface cooling of food in food pans, and certain prior arrangements directed to this goal are disclosed in the following U.S. Patents:

U.S. Pat. No. 4,685,311 Granted: Aug. 11, 1987

Title: Food Preparation Table Having A Refrigerated Ingredient Zone

U.S. Pat. No. 5,168,79 Granted: Dec. 8, 1992

Title: Food Preparation Table With Open Air Food Storage

U.S. Pat. No. 5,381,672 Granted: Jan. 17, 1995

Title: Cabinet Refrigeration System with Cold Air Distributor

U.S. Pat. No. 5,927,092 Granted: Jul. 27, 1999

Food Pan Refrigeration Unit

U.S. Pat. No. 6,089,036 Granted: Jul. 18, 2000

Title: Open-Top Chilling Apparatus

However, in some cases the proposed arrangements involve the flow of air over the food, and this air flow may impair the quality of the food being dispensed. Also, in some cases the food pans may be so recessed down into the food service counter or table, as to be inconvenient for the server to access the food. Further, there are many existing installations where the food pans have an upper lip which is substantially at the level of the serving counter or table; and these older installations may not adequately protect the food against spoilage resulting from the exposed upper surface of the food.

SUMMARY OF THE INVENTION

In accordance with one illustrative embodiment of the invention, a cooling collar or wrap is provided which may be retrofitted onto existing food pan service counters or tables. The collar or wrap may contain cooling coils, and may be coupled to the existing cooling system having the usual compressor and heat exchanger. The cooling collar or wrap is preferably somewhat lower or may be omitted at the front toward the server, for easy access, and may be somewhat higher at the back away from the server to provide additional cooling. By way of example and not of limitation, the height at the front of the collar toward the server may be about one to three inches, and the height at the back, away from the server may be about three to six or seven inches. Also, as noted above, the cooling collar may be open toward the server, and have only three sides with one side extending along the food pans on the side away from the server and also extending at least part way along the two ends of the installation. Alternatively, in order to provide better visibility for the customer, the collars may be the same height in the front and back, or may even be slightly lower in the front than the back.

Additional features may include an inner stainless steel liner and an outer metallic housing or shell, with the coils engaging the inner liner, and foamed-in-place insulation between the inner liner and the outer housing. The upper edges of the inner liner and outer housing may be separated by a thermally insulating strip. While the unit is particularly suitable for retrofit applications, initial complete installations may also be designed with substantially the same resultant configuration.

In accordance with another aspect of the invention, a food service cabinet may be provided with pans extending down into the cabinet, and a first cooling unit within the cabinet directing cooling fluid to cool the pans; and an additional upper cooling collar may be provided, with the collar configuration including constructional features as suggested hereinabove; and the two cooling arrangements may be coupled to a single compressor and heat exchanger.

Other objects, features and advantages of the invention will become apparent from a consideration of the following detailed description and from the accompanying drawings.

DETAILED DESCRIPTION OF THE PREFERRED EMBODIMENTS

Figure 1:
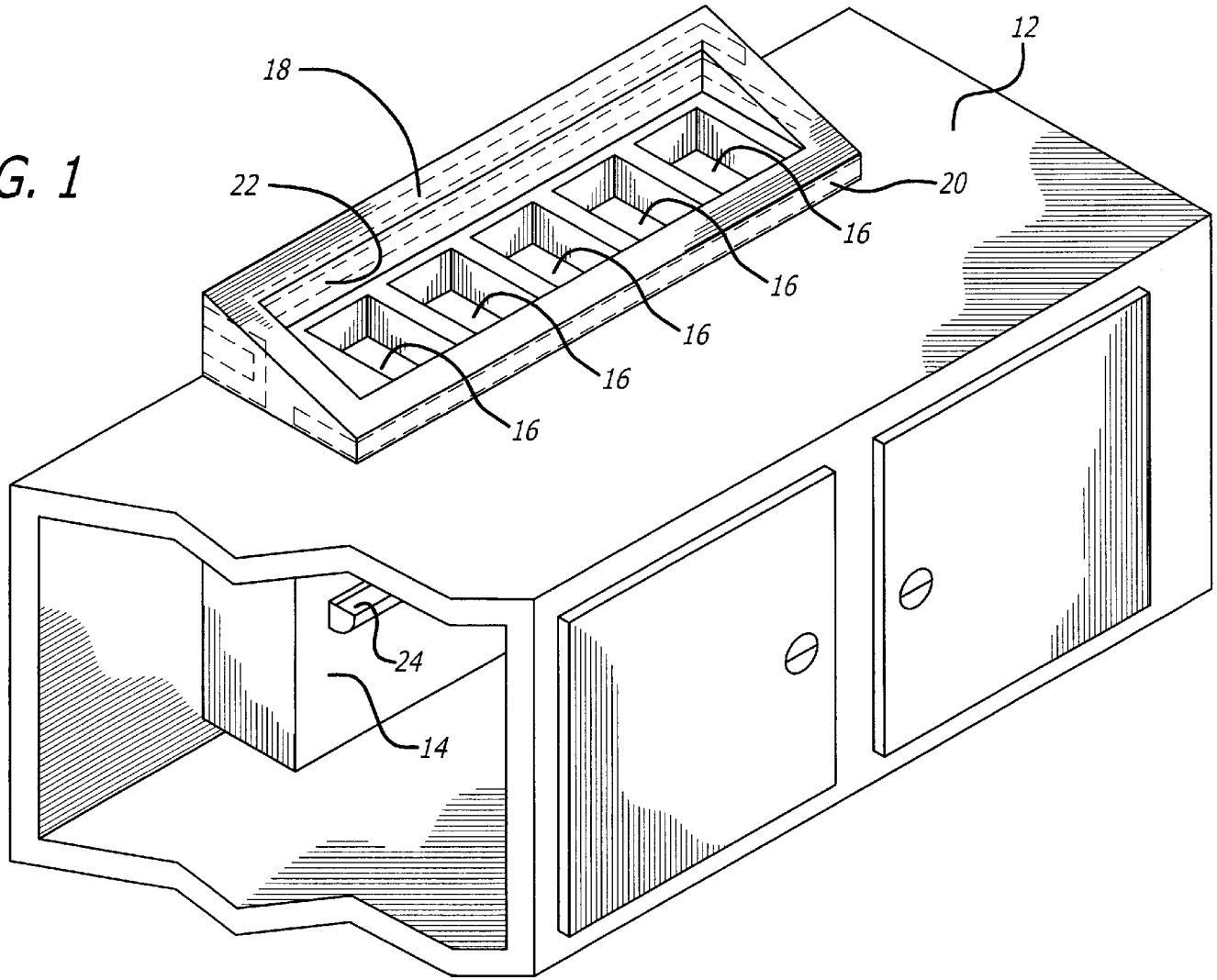
FIG. 1 is a perspective view of a refrigeration system illustrating the principles of the invention.

Referring more particularly to the drawings, FIG. 1 shows a refrigeration counter or cabinet 12 with an inner refrigeration unit 14 for directing cold air onto the lower surfaces of the food pans 16 which are recessed into the surface of the refrigeration cabinet 12. The refrigeration unit 14 may also cool the inside of cabinet 12 for food storage or the like.

A cooling collar 18 is mounted to extend around the upper surfaces of the food pans 16 to provide surface cooling. As shown in FIG. 1, the front 20 of the cabinet may be lower than the rear side 22 of the refrigeration system, for access by the server and to provide as much as cooling as is reasonably practical in view of the desire to have customers be able to see into the food pans and observe the food which is available. The principal cooling unit 14 may be mounted on the rear wall of cabinet 12, and includes arrangements 24 for directing cold air up toward the cooling pans 16. It is also noted that the principal cooling unit 14 may be of the configuration shown in my prior U.S. Pat. No. 5,381,672, and the disclosure of that patent is hereby incorporated into the present patent application by reference.

Figure 2:
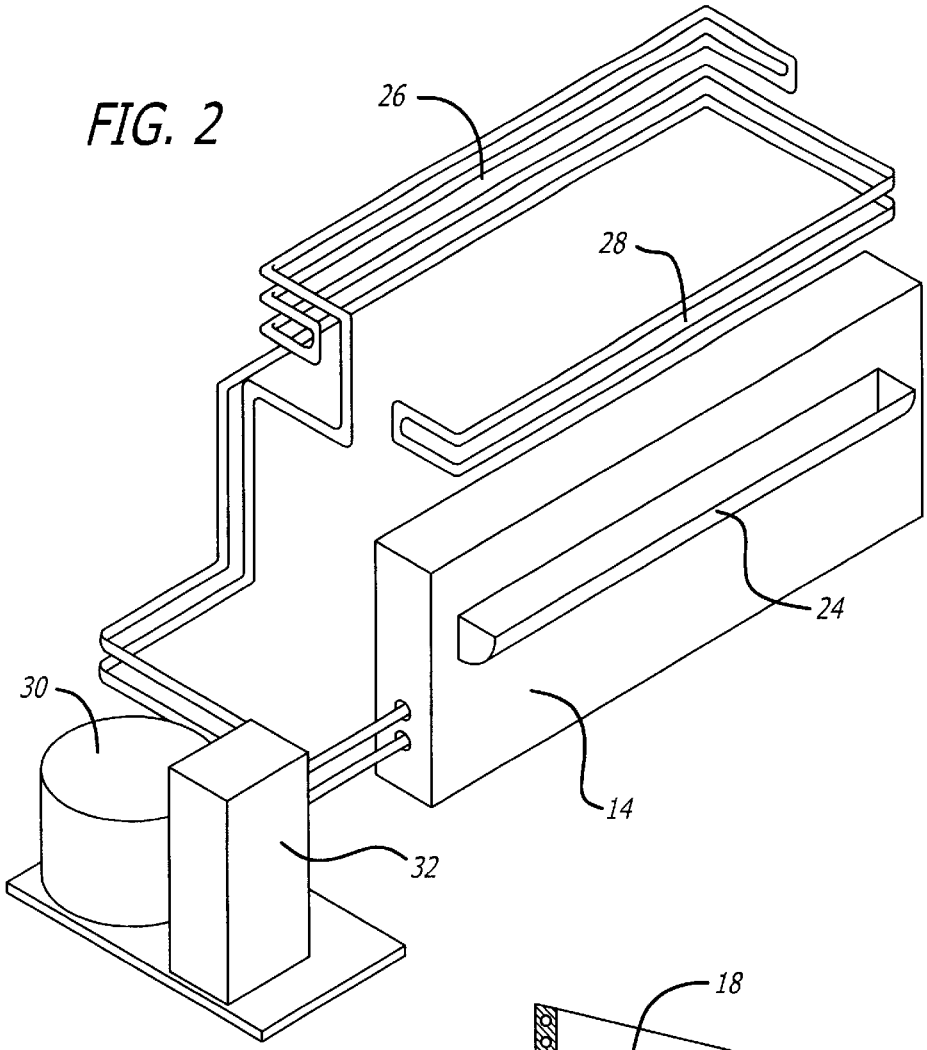
FIG. 2 is a schematic view of the refrigeration components of the system.
Figure 3:
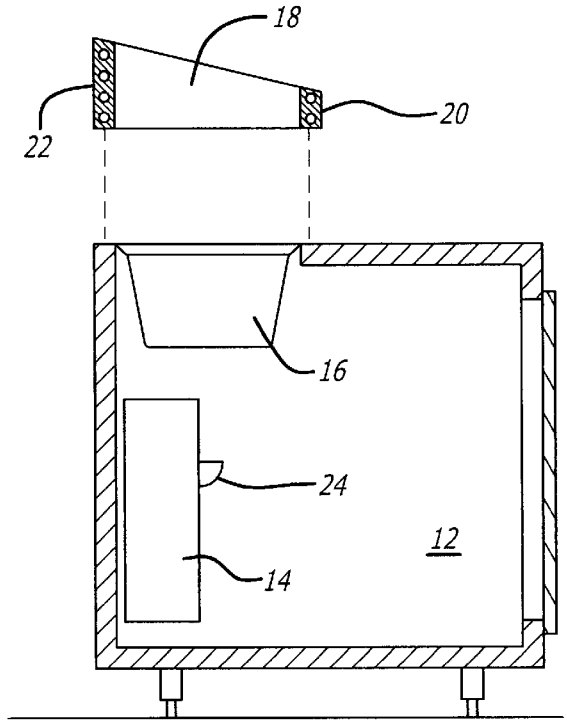
FIG. 3 is a schematic cross-sectional view of the pan installation.

Referring now to FIG. 2 of the drawings, it shows the complete refrigeration system including the principal cooling unit 14 with a baffle 24 for directing cold air upward toward the bottom of the food pans 16. In addition, the system of FIG. 2 includes the rear coils 26 and the front coils 28 associated with the collar 18 as shown in FIGS. 1 and 3 of the drawings. Also shown in FIG. 2 is a heat exchanger or cooling tower 30 and a compressor 32. The cooling tower or heat exchanger 30 and the compressor 32 are normally located outside of the building which the refrigeration unit or cabinet is located. In accordance with normal refrigeration practice, Freon™ or other similar refrigerant is returned to the compressor 32 where it is compressed and heated somewhat and routed to the heat exchanger or cooling tower 30 where it is liquefied, as its temperature is further reduced. Then the refrigerant is routed to an expansion valve (not shown), and the resultant cold refrigeration gas is directed to the refrigeration coils 26 and 28, as well as to similar refrigeration coils within the principal refrigeration unit 14.

Referring now to FIG. 3 of the drawings, a schematic cross-sectional view of the cabinet 12 of FIG. 1 is shown, with the cooling collar 18 being shown separated from the cabinet in order to emphasize that the collar 68 may be provided as a retrofit to existing food service counters or cabinets, or may be built as an integral part of the refrigeration system.

Figure 4:
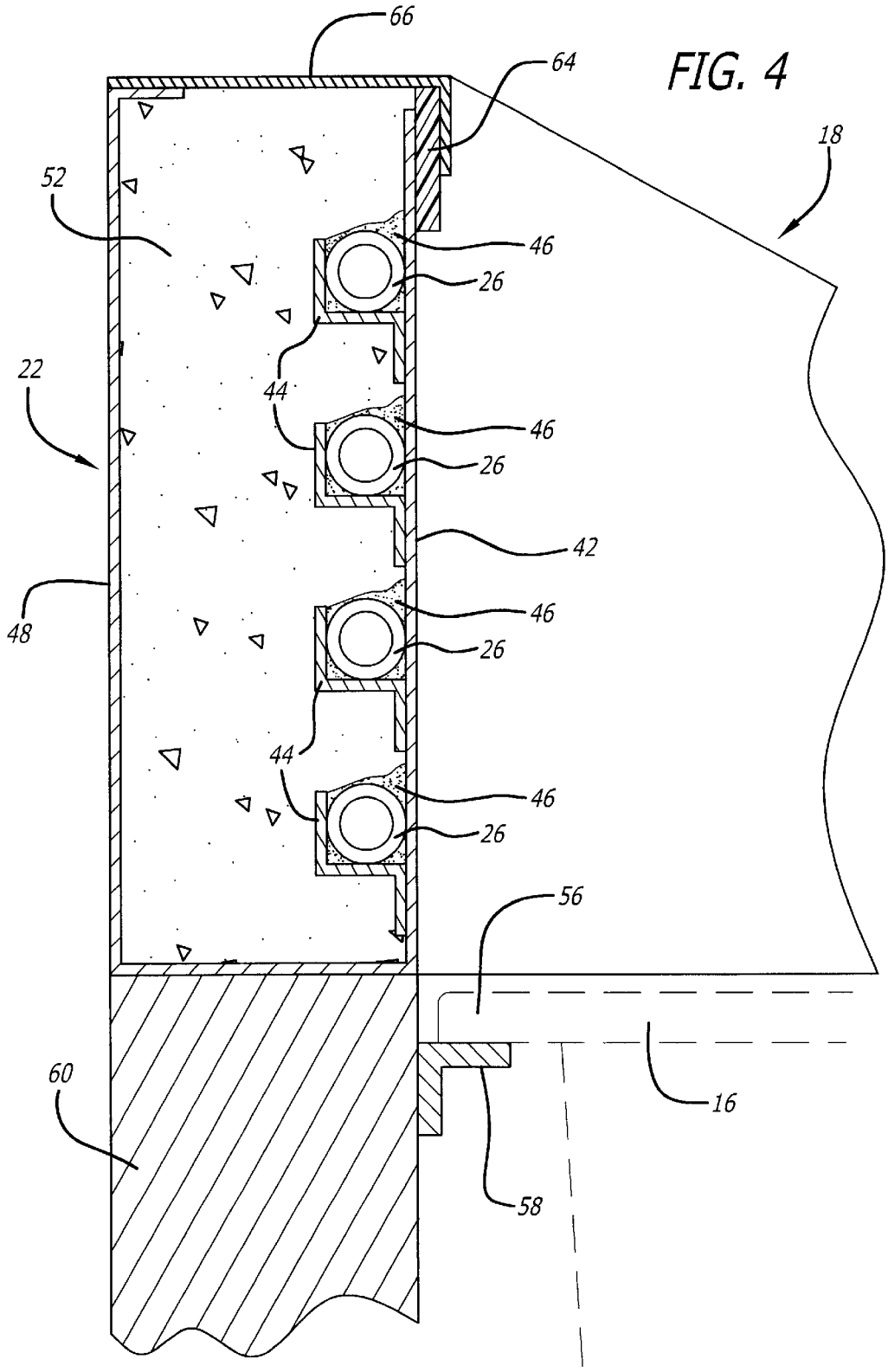
FIG. 4 is an enlarged cross-sectional view of the collar shown in FIGS. 1 and 3.

Referring now to FIG. 4 of the drawings, it is a cross sectional view through the wall 22 of the refrigeration collar, 18. The inner wall 42 of the collar 18 is preferably formed of stainless steel. In addition, Z-shaped supports 44 are mounted on the stainless steel wall 42 using spot welds, rivets, glue, or any other suitable technique. In addition, thermal mastic 46 is located around the cooling tubes 26 to ensure good heat transfer from the cooling coils to the inner wall 42 of the cooling collar. Thermal mastic is widely available from a number of sources but may for example, be purchased from Component Hardware having an address at 4560 Loma Vista Ave., Los Angeles, Calif. 90058. Following assembly of the cooling tubes within the chamber formed by the inner wall 42 and the outer wall 48, a foamed-in-place thermal insulating material is provided. It is applied through an opening in the outer wall 48 through a gun which combines two parts and injects the resultant material as a foam through the outer wall. The chemical name for the foam material is methane chlorodifluoro. Foam thermal insulating material is available from various sources, one of which is Foam Supply, Inc., having an address at 4387 North Rider Trail, Earth City, Mo. 63045. The foamed in place material is identified by reference numeral 52 in FIG. 4. A food pan 16 shown in dash lines in FIG. 4 has an outwardly extending lip 56 which rests on a L-shaped support member 58 which is mounted on the wall 60 on the main part of the food service cabinet or counter 12. The support member 58 may be continuous around the rim of the food pan or may be in the form of a series of spaced brackets.

With reference to FIG. 4 of the drawings, attention is directed to the thermal breaker strip 64 made of a strip of low thermal conductivity insulating material, and to the upper stainless steel closure member 66. In the absence of the breaker strip 64, the top cover plate 66 could become unduly cold, and undesired moisture would condense on the surface thereof.

Figure 5:
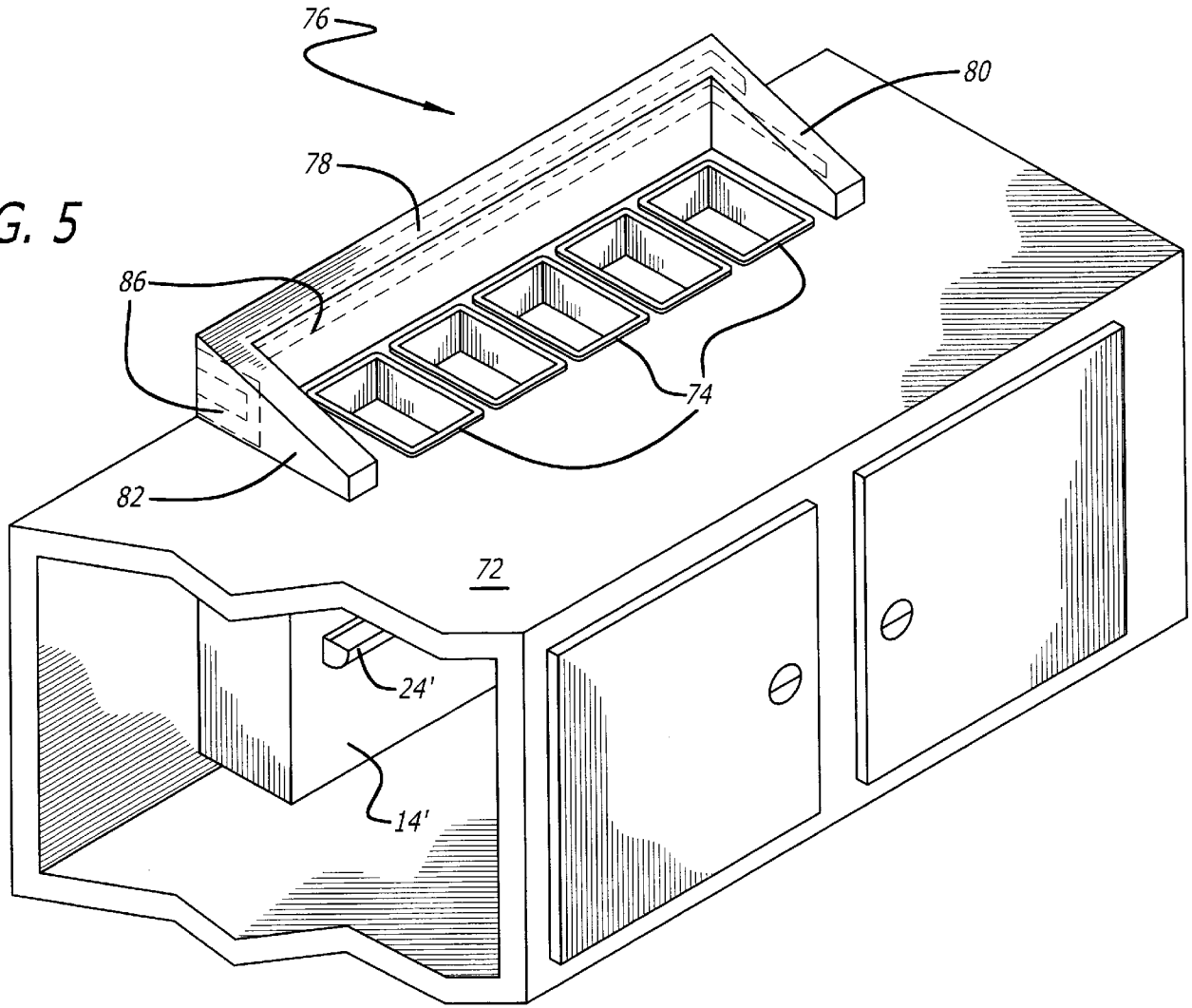
FIG. 5 shows an open collar refrigeration arrangement in which the cooling collar extends around three sides of the food service.

Referring now to FIG. 5 of the drawings, this embodiment includes an open collar construction in which the cabinet 72 has food pans 74 and an open front cooling collar 76. The cooling collar 76 includes the extended side 78 on the side of the installation away from the server, and the two end portions 80 and 82 extending at least partially along the ends of the linear array of food pans 74. As in the case of the other installations described hereinabove, the cooling coils 86 may be mounted within the cooling walls 78, 80 and 82.

It may also be noted that the inner cooling unit 14' and the deflector 24' are also visible in FIG. 5; and the FIG. 5 system may be cooled in accordance with the system shown in FIG. 2 of the drawings.

In the foregoing detail and description, illustrative preferred embodiments of the invention have been disclosed. However, various changes and modifications may be made without departing from the spirit and scope of the invention. Thus, by way of example and not of limitation, the cooling collar may be either a separate unit available for retrofitting onto existing food service refrigeration units, or may be integrally built into food service cabinets. Concerning the thermal mastic, any material having high thermal conductivity properties may be employed, and even without the thermal mastic, good heat conduction is provided by engagement of the coils 26 with the wall 42, and by the supplemental heat or cooling conduction properties of the Z-shaped bracket members 44. Instead of the foamed-in-place thermal insulation 52, preformed slabs of thermal insulation material may be employed. Other high heat conductivity material may be employed instead of stainless steel. Concerning the height of the collar, the front of the unit toward the server is preferably about two inches or one to three inches in height, or the front portion may be omitted, and the height of the rear wall 22 is preferably about 4 inches; and it may be, for example, from 2 to 7 inches in height in accordance with the nature of the facility and the appropriate design parameters. The main cooling arrangements for the food pans may be a separate unit mounted within the cabinet as shown, or may involve additional coils extending around the food pans 16, within the cabinet, either with or without the additional main cooling unit 14. Accordingly, the present invention is not limited the specific design shown in the drawings and described in detail hereinabove.

What is claimed is:

1. A food service refrigeration system comprising:

an enclosed cabinet, food pans extending down into said cabinet, and a principal cooling unit mounted in said cabinet mounted to direct cold air onto said food pans;

a cooling collar including a stainless steel inner liner, cooling coils in engagement with said liner and a layer of insulating material extending around said coils;

said collar extending around at least three sides of said food service pans, and having a lower portion mounted on the upper surface of said cabinet;

an external compressor and heat exchanger; and conduits for concurrently providing cooling fluid to said coils in said collar and to said principal cooling unit, said conduits being coupled to said compressor and heat exchangers.

2. A food service refrigeration system as defined in claim 1 wherein said collar has only three sides and is open on one side for easy access to the food pans.

3. A refrigeration system as defined in claim 1 further comprising an outer metal housing enclosing said collar, said inner liner and said outer metal housing having upper edges which are adjacent to each other, and a thermally insulating strip mounted between the upper edges of said inner liner and said outer housing, whereby condensation on said outer housing is avoided.

4. A refrigeration system as defined in claim 1 further comprising an outer metal housing and wherein said layer of insulating material is foamed-in-place thermally insulating material.

5. A refrigeration system as defined in claim 1 wherein said collar is formed integrally with said counter or table.

6. A refrigeration system as defined in claim 1 wherein said collar is formed separately from and is mounted on said counter or table and extends at least partially around the top of said food pans.

7. A refrigeration system as defined in claim 1 wherein the and the rear of said collar away from the server is from about 3 to 7 inches in height.

8. A food service refrigeration system for retrofitting existing food service counters or tables, having cooled food pans recessed into the counter or cabinet, comprising:

a cooling collar formed independently of said counter or cabinet, including an inner liner of high heat conductivity material, cooling coils in engagement with said liner and a layer of insulating material extending around the outside of said coils; and said collar having at least three sides for extending at least partially around food service pans, and having a base for mounting on the food service counter or table.

9. A food service refrigeration system as defined in claim 8 wherein said collar has only three sides and is open on one side for easy access to the food pans.

10. A refrigeration system as defined in claim 6 further comprising a principal cooling unit for cooling said pans, an external compressor and heat exchanger, and conduits for concurrently providing cooling fluid to said pipes in said collar and to said principal cooling unit, said conduits being coupled to said compressor and heat exchangers.

11. A refrigeration system as defined in claim 6 further comprising an outer metal housing enclosing said collar, said inner liner and said outer metal housing having upper edges which are adjacent to each other, and a thermally insulating strip mounted between the upper edges of said inner liner and said outer housing, whereby condensation on said outer housing is avoided.

12. A refrigeration system as defined in claim 8 further comprising an outer metal housing and wherein said layer of insulating material is foamed-in-place thermally insulating material.

13. A refrigeration system as defined in claim 8 further comprising an enclosed cabinet, food pans extending down into said cabinet, and a principal cooling unit mounted in said cabinet and directing cold air onto said food pans.

14. A refrigeration system as defined in claim 8 wherein the rear of said collar away from the server is from about 3 to 7 inches in height.

15. A food service refrigeration system for food service counters or tables, having cooled food pans recessed into the counter or tables, comprising:

a cooling collar including a inner liner of high heat conductivity material, cooling coils in engagement with said liner and a layer of insulating low heat conductivity material extending around said coils;

said collar having at least three sides for extending at least partially around food service pans, and having a lower portion engaging the food service counter or table; and said collar being arranged for positioning about the upper edges of said food pans.

16. A refrigeration system as defined in claim 15 further comprising a principal cooling unit for cooling said pans, an external compressor and heat exchanger, and conduits for concurrently providing cooling fluid to said pipes in said collar and to said principal cooling unit, said conduits being coupled to said compressor and heat exchangers.

17. A food service refrigeration system as defined in claim 15 wherein said collar has only three sides and is open on one side for easy access to the food pans.

18. A refrigeration system as defined in claim 15 further comprising an outer housing enclosing said collar, said inner liner and said outer housing having upper edges which are adjacent to each other, and a thermally insulating strip mounted between the upper edges of said inner liner and said outer housing, whereby condensation on said outer housing is avoided.

19. A refrigeration system as defined in claim 15 wherein said collar is formed integrally with said counter or table.

20. A refrigeration system as defined in claim 15 wherein said collar is formed separately from and is mounted on said counter or table and extends at least partially around the top of said food pans.

21. A refrigeration system as defined in claim 13 wherein the rear of said collar is from about 2 to 7 inches in height above the level of the upper edges of said food pans.

* * * * *